US007652391B2

(12) United States Patent
Kim

(10) Patent No.: US 7,652,391 B2
(45) Date of Patent: Jan. 26, 2010

(54) STARTING BUTTON APPARATUS FOR VEHICLE

(75) Inventor: Jong Gyu Kim, Incheon (KR)

(73) Assignee: Hyundai Motor Company, Seoul (KR)

( * ) Notice: Subject to any disclaimer, the term of this patent is extended or adjusted under 35 U.S.C. 154(b) by 101 days.

(21) Appl. No.: 12/082,287

(22) Filed: Apr. 9, 2008

(65) Prior Publication Data

US 2009/0115250 A1 May 7, 2009

(30) Foreign Application Priority Data

Nov. 5, 2007 (KR) ..... 10-2007-0112083

(51) Int. Cl.
*E05B 17/00* (2006.01)

(52) U.S. Cl. ..... 307/10.3

(58) Field of Classification Search ..... 307/10.3
See application file for complete search history.

(56) References Cited

U.S. PATENT DOCUMENTS 7,576,636 B2 * 8/2009 Dornbach et al. ..... 340/426.1

* cited by examiner

*Primary Examiner*—Robert L. Deberadinis
(74) *Attorney, Agent, or Firm*—Edwards Angell Palmer & Dodge LLP; Peter F. Corless

(57) ABSTRACT

A starting button apparatus for a vehicle includes a switch body, an antenna coil, a reciprocation housing, and a rotation housing. The switch body includes a key hole therein, into which a key fob is inserted, and a starting button mounted thereto. The antenna coil is provided to the switch body to allow power to be applied to the key fob inserted into the key hole. The reciprocation housing is secured to an outer surface of the starting button and has a first inclined guide. The rotation housing is fitted around the reciprocation housing and has a second inclined guide which is slidably engaged with the first inclined guide so as to push the starting button when the inserted key fob is rotated.

5 Claims, 6 Drawing Sheets

STARTING BUTTON APPARATUS FOR VEHICLE

CROSS-REFERENCE TO RELATED APPLICATIONS

This application claims priority to Korean Application No. 10-2007-0112083, filed on Nov. 5, 2007, the disclosure of which is incorporated herein by reference.

BACKGROUND

1. Technical Field

The present invention relates to a starting button apparatus for a vehicle which allows a vehicle to be started using a key fob.

2. Background Art

A PIC (personal identification card) system applied to a vehicle allows opening and closing of a door, starting of a vehicle, etc. to be implemented through communication without using a conventional key.

In the PIC system, communication between the vehicle and a driver is conducted using a key fob. The key fob is provided with a transponder for preventing communication from being disabled in the event of discharge of a battery. A fob holder is installed in the cabin of the vehicle as a separate device to supply power to the transponder when the key fob is fitted therein.

However, since the fob holder is installed in the cabin of the vehicle as a separate device, the aesthetic appearance inside the cabin is likely to be deteriorated, and limitations are imposed on the layout of the vehicle.

The information disclosed in this Background section is only for enhancement of understanding of the background of the invention and should not be taken as an acknowledgement or any form of suggestion that this information forms the prior art that is already known to a person skilled in the art.

SUMMARY OF THE DISCLOSURE

Accordingly, the present invention has been made keeping in mind the above problems occurring in the prior art, and an object of the present invention is to provide a starting button apparatus for a vehicle which allows a vehicle to be started even when the battery of a key fob is discharged.

In order to achieve the above object, a starting button apparatus for a vehicle according to the present invention includes a switch body, an antenna coil, a reciprocation housing, and a rotation housing. The switch body defines therein a key hole, into which a key fob is inserted, and includes a starting button mounted thereto. The antenna coil is provided to the switch body to allow power to be applied to the key fob inserted into the key hole. The reciprocation housing is secured to the outer surface of the starting button and has a first inclined guide. The rotation housing is fitted around the reciprocation housing and has a second inclined guide which is slidably engaged with on the first inclined guide so as to push the starting button when the inserted key fob is rotated.

In a preferred embodiment, the key fob includes a transponder mounted thereon, which can receive power from the antenna coil and transmit and receive a signal in an emergency situation.

In another preferred embodiment, the starting button apparatus may further include holders. The holders are coupled to the rotation housing via springs to allow edge portions of the key fob to be received therein.

In still another preferred embodiment, the key hole has insertion grooves into which the key fob is inserted. Engagement grooves may be defined adjacent to the end of the key fob to guide the rotation of the key fob in the key hole.

In a further preferred embodiment, the reciprocation housing is formed in the shape of a ring, the starting button is secured to the inner surface of the reciprocation housing, and the first inclined guide is inclinably mounted on the outer surface of the reciprocation housing. The rotation housing is formed in the shape of a ring, and the second inclined guide is inclinably mounted on the inner surface of the rotation housing.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like.

Other features of the invention are discussed infra.

BRIEF DESCRIPTION OF THE DRAWINGS

The above and other features of the present invention will now be described in detail with reference to certain exemplary embodiments thereof illustrated the accompanying drawings which are given hereinbelow by way of illustration, and thus are not limitative of the present invention, and wherein.

Figure 1:
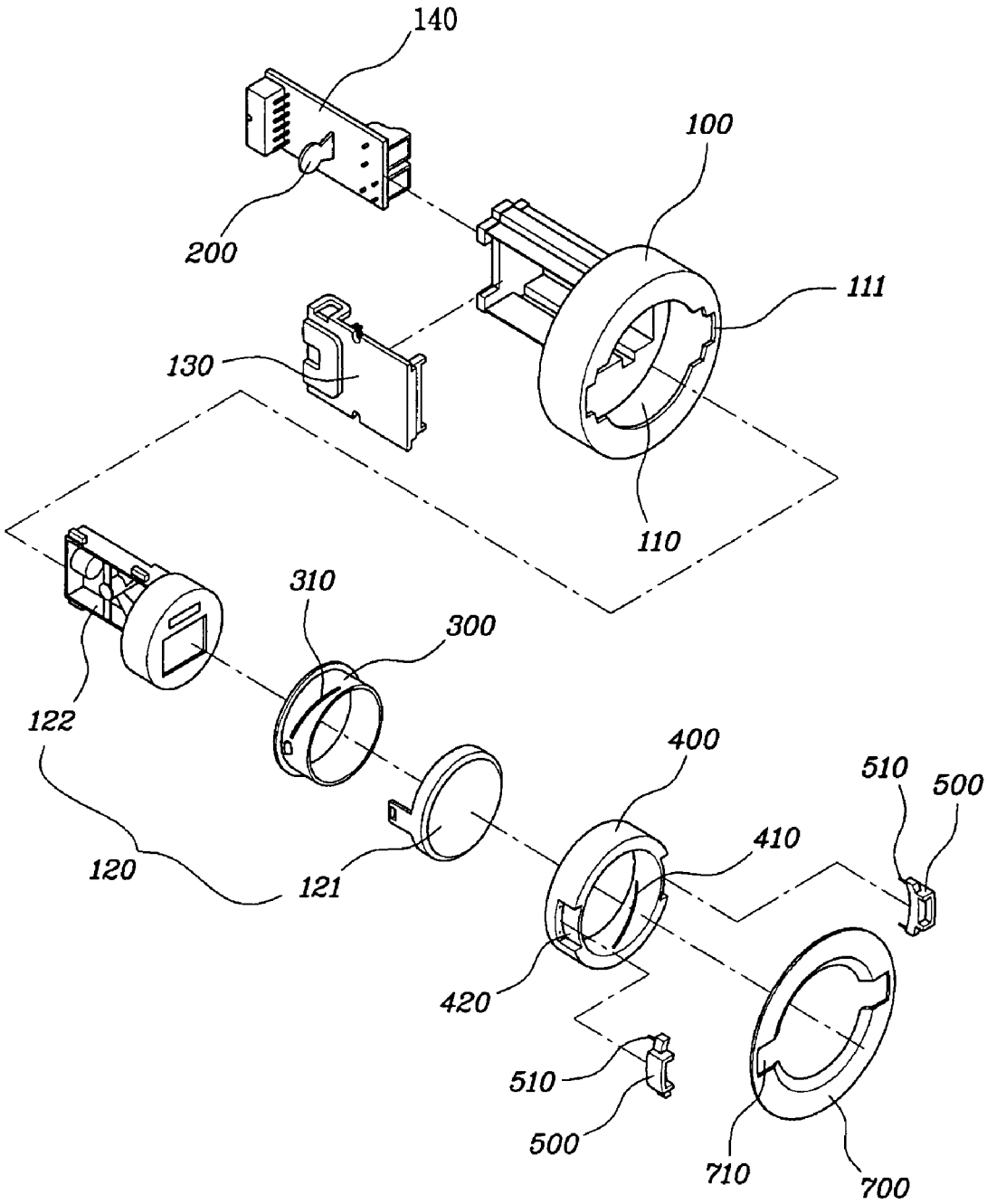
FIG. 1 is an exploded perspective view illustrating a starting button apparatus for a vehicle in accordance with an embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to a preferred embodiment of the present invention, an example of which is illustrated in the accompanying drawings and described below. While the invention will be described in conjunction with an exemplary embodiment, it should be understood that the description is not intended to limit the invention to the exemplary embodiment. On the contrary, the invention is intended to cover not only the exemplary embodiment, but also various alternatives, modifications, equivalents and other embodiments, which may be included within the spirit and scope of the invention as defined by the appended claims.

Figure 2:
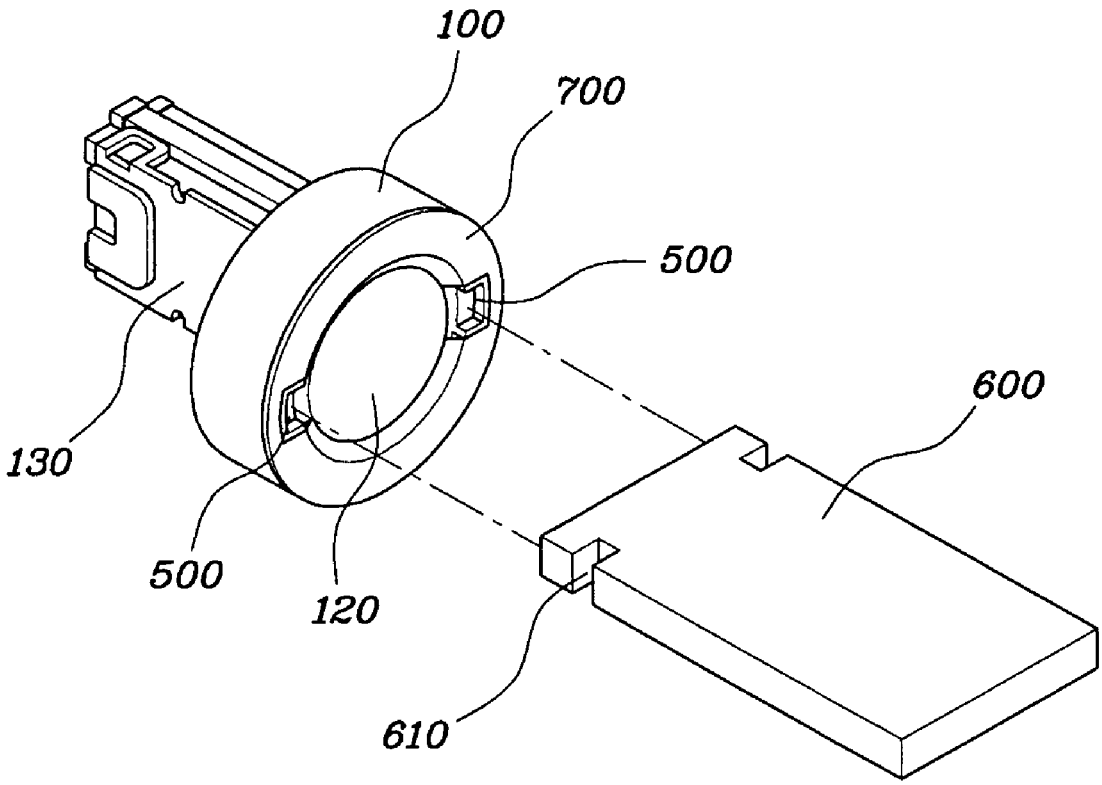
FIG. 2 is a perspective view illustrating the starting button apparatus for a vehicle according to the present invention.

Referring to FIGS. 1 and 2, a starting button apparatus for a vehicle in accordance with an embodiment of the present invention is generally installed adjacent to a steering column which is provided in front of a driver's seat.

The starting button apparatus includes a switch body 100, into which a key fob 600 is inserted, an antenna coil 200, which is provided in the switch body 100, a reciprocation housing 300, which is fastened to the outer surface of a starting button 120, a rotation housing 400, which is fitted around the reciprocation housing 300 to press the starting button 120 via the reciprocation housing 300 when the key fob 600 is inserted into the switch body 100 and rotated, and holders 500, into which the key fob 600 is fitted.

The switch body 100 has a space in which the antenna coil 200, the reciprocation housing 300 and the rotation housing 400 are disposed. A side cover 130 is provided on a side of the switch body 100 to cover the space. A PCB (printed circuit board) 140 for controlling the antenna coil 200 is mounted to the switch body 100.

When the key fob 600 is disabled upon the discharge of the battery thereof, the antenna coil 200 allows power to be supplied to the key fob 600, which is inserted into the key hole 110 defined in the switch body 100. The key fob 600 is provided with a transponder which can transmit and receive a signal to and from the antenna coil 200. If a key fob 600, the battery of which is discharged, is inserted into the key hole 110, the antenna coil 200 generates an electric field, and the transponder can transmit the signal to the antenna coil 200 through the electric field.

The key hole 110 for insertion of the key fob 600 is defined in the front part of the switch body 100. The starting button 120 is fitted into the key hole 110 and is coupled to the switch body 100. The starting button 120 includes a button body 122 and a button cover 121 mounted to the front surface of the button body 122. The vehicle can be started when the starting button 120 is pushed. The starting button 120 can be actuated only when the signal, transmitted from the transponder of the key fob 600, matches the signal inputted in advance to the vehicle.

Insertion grooves 111, into which the key fob 600 is inserted, are defined in the switch body 100 and communicate with the key hole 110. Adjacent to an end of the key fob 600, engagement grooves 610 are defined to guide the rotation of the key fob 600 in the key hole 110. As a result, after the key fob 600 is inserted into the insertion grooves 111, the key fob 600 can be rotated with portions of the switch body 100 engaged in the engagement grooves 610 of the key fob 600, by which the starting button 120 is pushed via the rotation housing 400 and the reciprocation housing 300.

Figure 3:
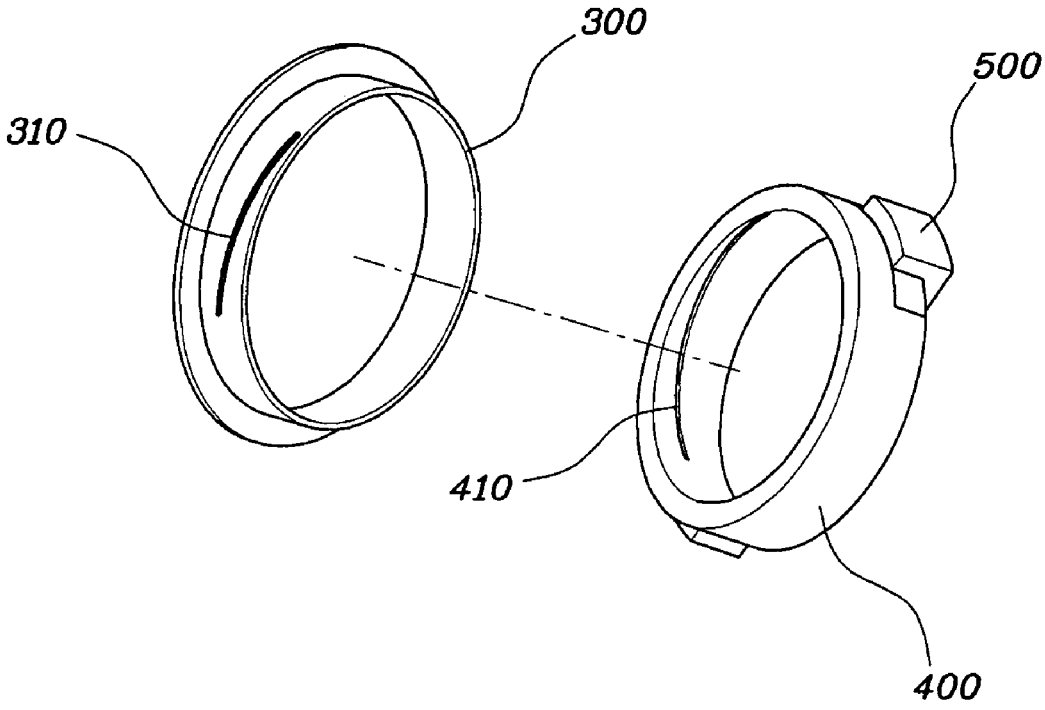
FIG. 3 is an exploded perspective view illustrating the push unit of the starting button apparatus for a vehicle according to the present invention.
Figure 4A:
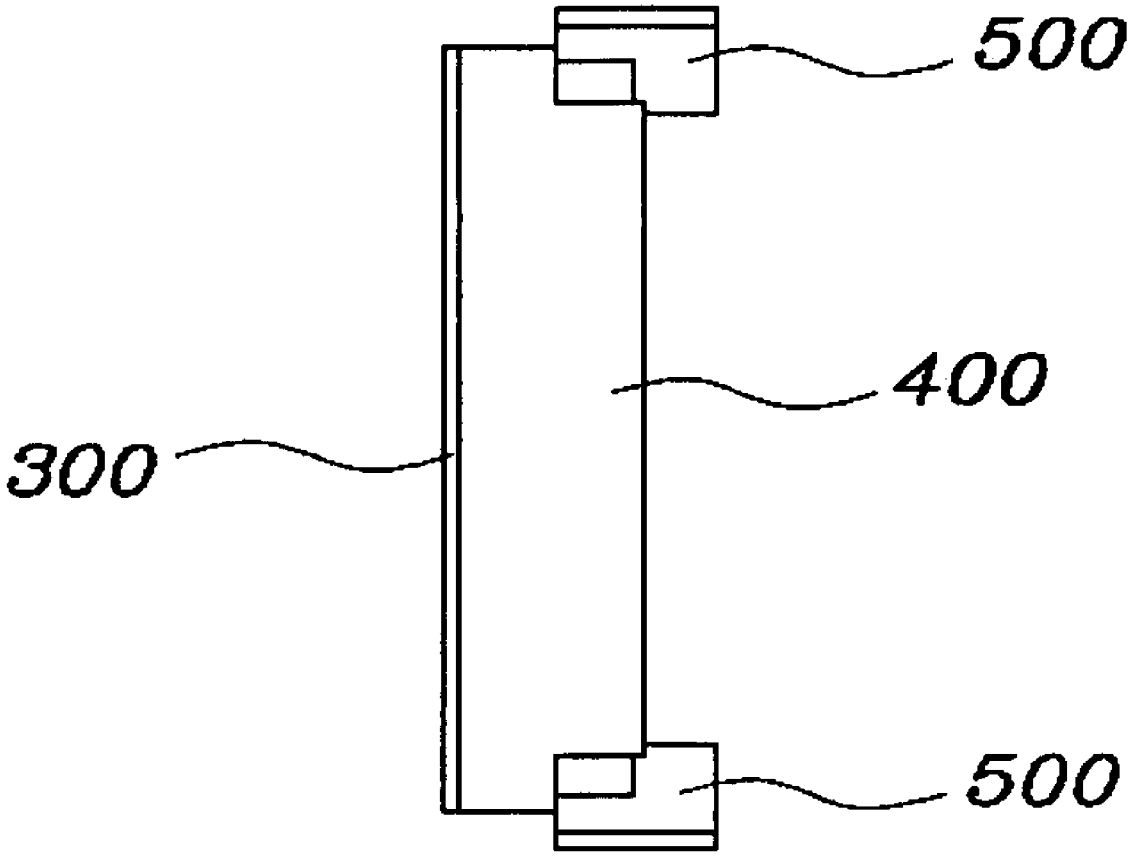
FIGS. 4A and 4B are views respectively illustrating states before and after the push unit of the starting button apparatus for a vehicle according to the present invention is actuated.

Referring to FIGS. 3 and 4A, the reciprocation housing 300 is formed in the shape of a ring which surrounds the outer surface of the starting button 120. The inner surface of the reciprocation housing 300 is fastened to the outer surface of the starting button 120. A first inclined guide 310 is formed on the outer surface of the reciprocation housing 300 in the shape of a band which extends at an incline.

The rotation housing 400 is formed in the shape of a ring which surrounds the outer surface of the reciprocation housing 300. A second inclined guide 410 is formed on the inner surface of the rotation housing 400 in the shape of a band which extends at an incline. The second inclined guide 410 is placed on the first inclined guide 310.

Also, holder grooves 420, in which the holders 500 are received, are defined in both opposite sides of the rotation housing 400. The holders 500 are coupled to the rotation housing 400 via springs 510, and function to securely hold the key fob 600 which is inserted into the key hole 110.

Figure 4B:
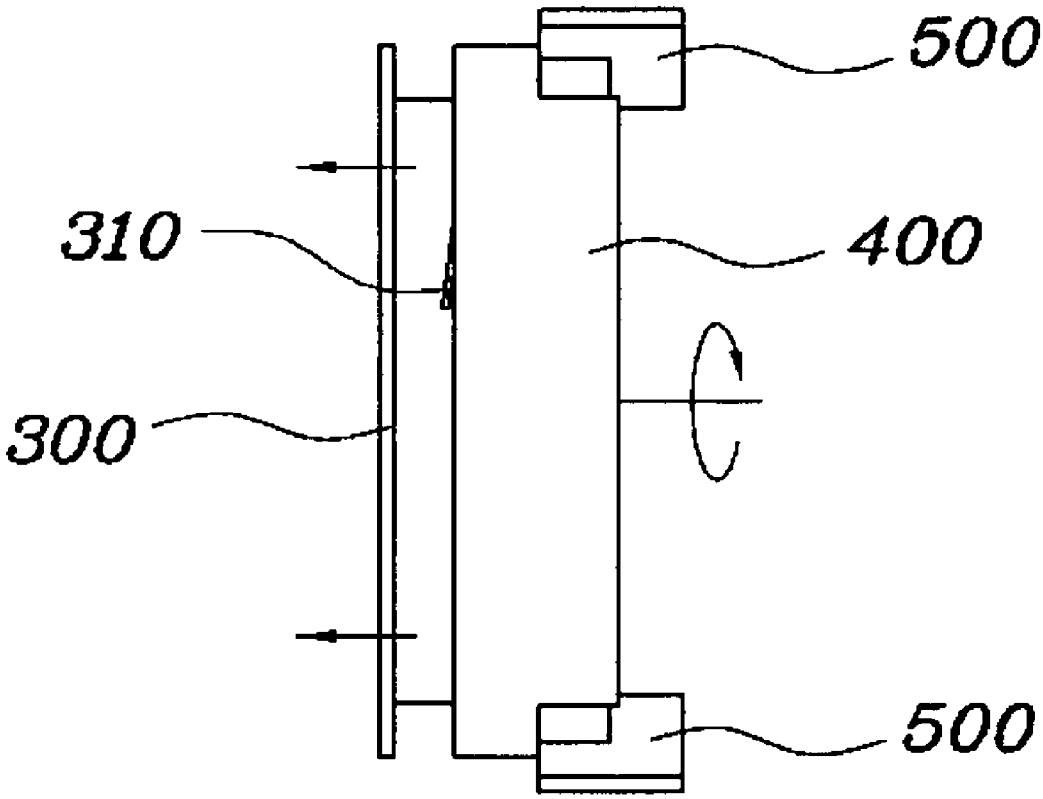

Referring to FIG. 4B, when the key fob 600 is rotated with both edge portions of the key fob 600 inserted into the holders 500, the rotation housing 400 is rotated. By the rotation of the rotation housing 400, the second inclined guide 410 slides on and presses the first inclined guide 310. As a result, because the reciprocation housing 300 is pushed by the rotation of the rotation housing 400, the starting button 120 can be pushed by the rotation of the key fob 600.

A decorative ring 700 can be attached to the front surface of the rotation housing 400. The decorative ring 700 is fitted around the front end of the rotation ring 400 and has introduction grooves 710 through which the key fob 600 is inserted.

Hereafter, the operation of the starting button apparatus for a vehicle according to the present invention will be described.

As shown in FIG. 2, the key fob 600, which is disabled due to the discharge of the battery thereof, is inserted into the key hole 110 of the starting button apparatus. As the key fob 600 is inserted into the key hole 110, the antenna coil 200 generates an electric field, and the transponder transmits the signal through the electric field. If the signal transmitted from the transponder corresponds to the signal inputted in advance to the vehicle, the starting button 120 is ready to be pushed.

Figure 5:
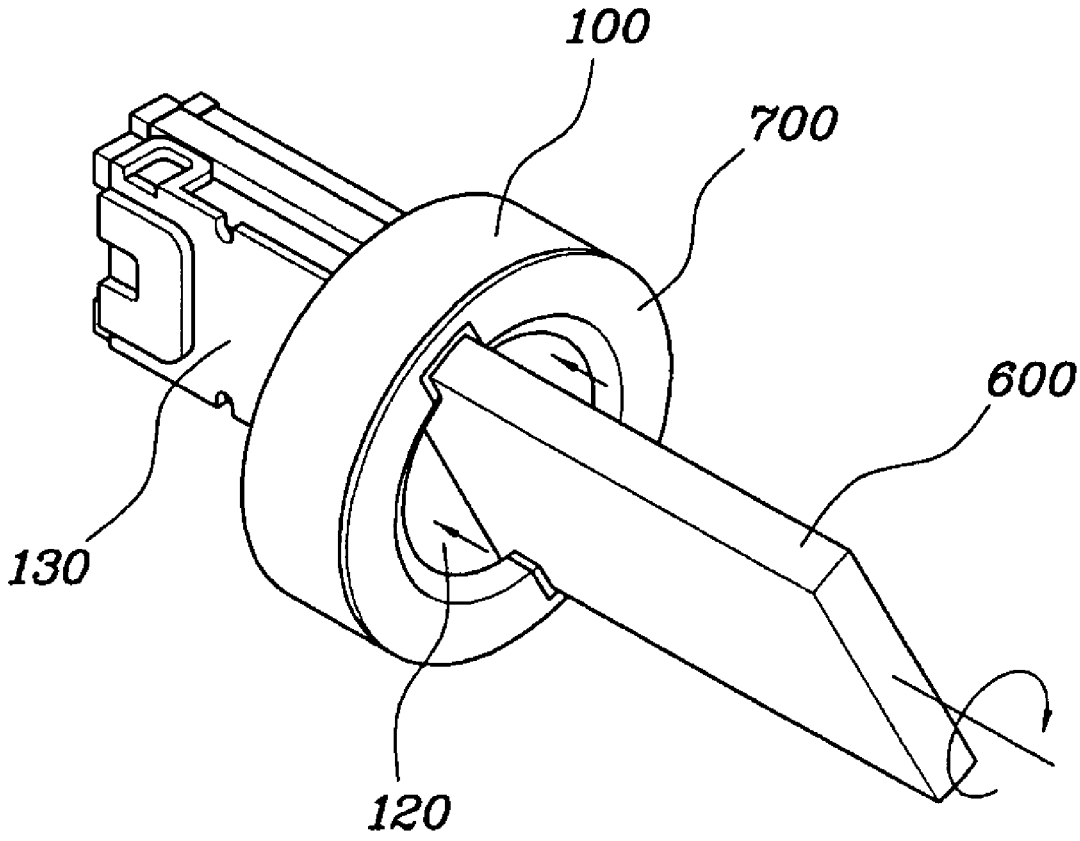
FIG. 5 is a perspective view illustrating the use of the starting button apparatus for a vehicle according to the present invention.

As shown in FIG. 5, if the key fob 600 is rotated with the end of the key fob 600 inserted into the holders 500, the second inclined guide 410 of the rotation housing 400 slides on and presses the first inclined guide 310. As the first inclined guide 310 is pressed, the reciprocation housing 300 is pushed. As a consequence, the starting button 120 is pushed by the rotation of the key fob 600, whereby the vehicle can be started.

After the vehicle is started, by rotating the key fob 600 to its initial position, the key fob 600 can be removed from the insertion grooves 111 of the key hole 110.

As is apparent from the above description, the present invention provides advantages in that, even when the battery of a key fob is discharged, thus disabling communication, a vehicle can be started through the simple manipulation of inserting the key fob into a key hole and rotating the key fob.

Therefore, in the present invention, it is possible to prevent the aesthetic appearance in the cabin of a vehicle from being deteriorated due to the installation of a fob holder.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A starting button apparatus for a vehicle, comprising:

a switch body having a key hole, into which a key fob is inserted, and having a starting button mounted thereto;

an antenna coil provided to the switch body to allow power to be applied to the key fob inserted into the key hole;

a reciprocation housing secured to an outer surface of the starting button and having a first inclined guide; and a rotation housing fitted around the reciprocation housing and having a second inclined guide which is slidably engaged with the first inclined guide so as to push the starting button when the inserted key fob is rotated.

2. The starting button apparatus according to claim 1, wherein the key fob is provided with a transponder for receiving power from the antenna coil and transmitting and receiving a signal in an emergency situation.

3. The starting button apparatus according to claim 1, further comprising:

holders coupled to the rotation housing via springs to allow edge portions of the key fob to be received therein.

4. The starting button apparatus according to claim 3, wherein the key hole is provided with insertion grooves into which the key fob is inserted, and the key fob is provided with engagement grooves defined adjacent to an end thereof to guide rotation of the key fob in the key hole.

5. The starting button apparatus according to claim 1, wherein the reciprocation housing is formed in a ring shape, the starting button is secured to an inner surface of the reciprocation housing, and the first inclined guide is mounted on an outer surface of the reciprocation housing, and wherein the rotation housing is formed in a ring shape, and the second inclined guide is mounted on an inner surface of the rotation housing.

* * * * *